United States Patent [19]

Bernhart et al.

[11] Patent Number: 4,726,781

[45] Date of Patent: Feb. 23, 1988

[54] CONNECTIVE MECHANISM FOR ADJACENT FLUORESCENT FIXTURES

[75] Inventors: Horst Bernhart, Ontario; Kingsley Chan, Rolling Hills Estate, both of Calif.

[73] Assignee: Lightolier Incorporated, Secaucus, N.J.

[21] Appl. No.: 46,100

[22] Filed: May 5, 1987

[51] Int. Cl.[4] ..... H01R 33/02

[52] U.S. Cl. ..... 439/228; 439/235; 439/529; 439/541; 439/576; 362/219

[58] Field of Search ..... 439/226, 227, 228, 230, 439/231, 233–244, 529, 541, 576; 362/365, 366, 219, 222, 224

[56] References Cited

U.S. PATENT DOCUMENTS

| | | | |
|---|---|---|---|
| 2,831,962 | 4/1958 | Winkler et al. | 362/219 |
| 2,973,177 | 2/1961 | Stubbs | 362/219 |
| 2,982,850 | 5/1961 | Lister et al. | 439/234 |
| 3,319,059 | 5/1967 | Ogden | 362/219 |
| 3,349,237 | 10/1967 | Jackson | 362/219 |

*Primary Examiner*—Gil Weidenfeld
*Assistant Examiner*—David Pirlot
*Attorney, Agent, or Firm*—Arthur B. Colvin

[57] ABSTRACT

A connector mechanism for linking the ends of successive fluorescent fixtures includes a pair of plates defining the ends of the fixtures, one said plate including a projecting hook portion which extends through the other said plate. The hook poriton includes a cam surface inclined toward the first plate, the second plate including a slide having a locking shoulder positioned to engage the cam surface. A threaded connection to the slide enables the slide to be drawn along the cam surface and accordingly to clamp the end plates tightly against each other.

6 Claims, 5 Drawing Figures

FIG. 2
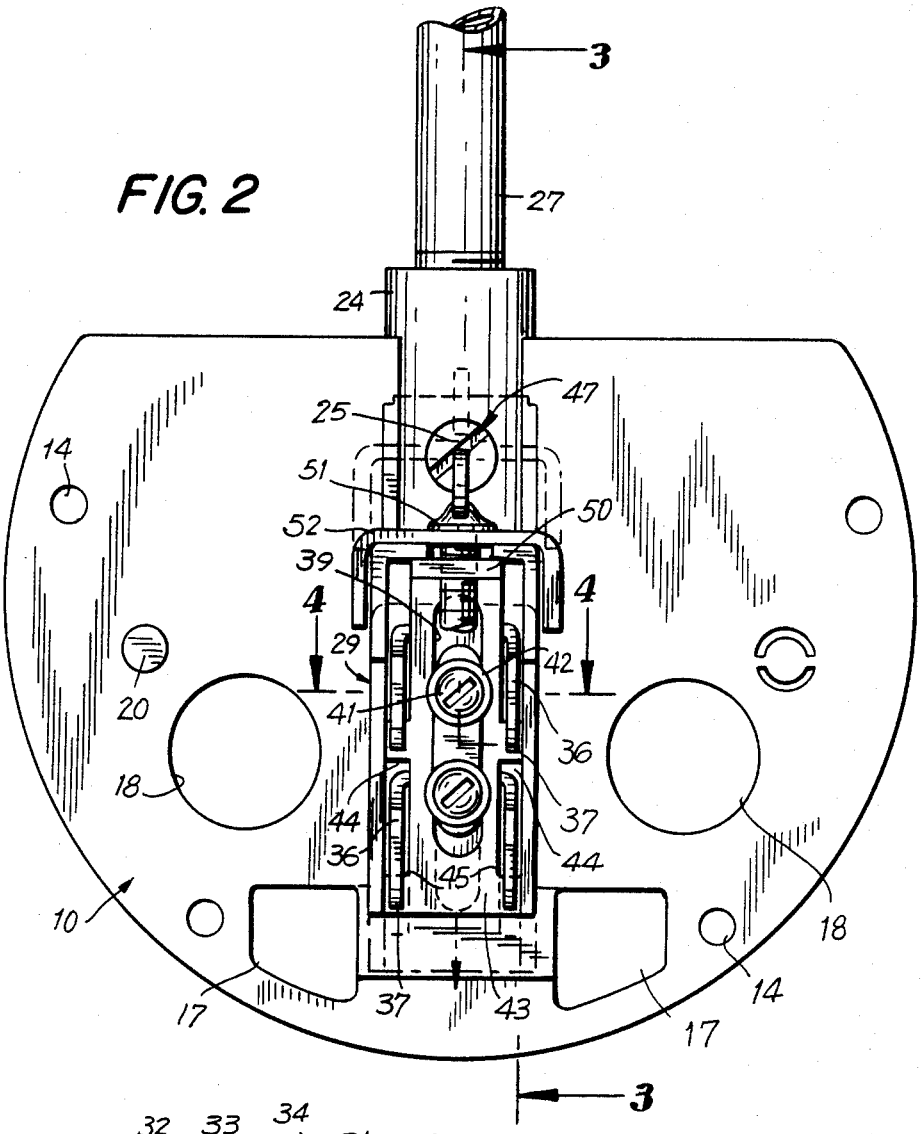
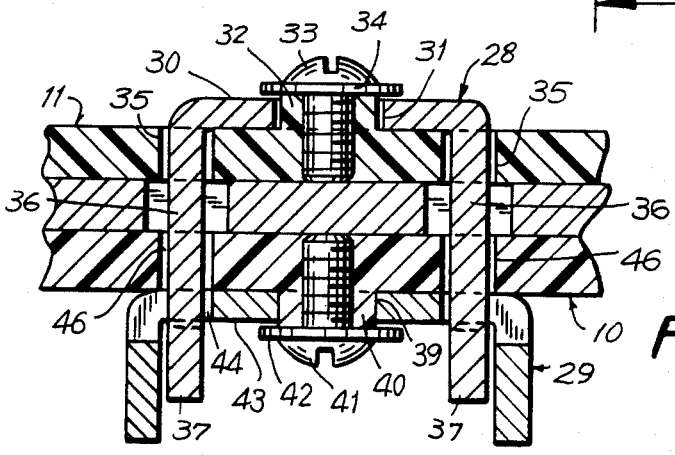
FIG. 4

CONNECTIVE MECHANISM FOR ADJACENT FLUORESCENT FIXTURES

BACKGROUND OF THE INVENTION

1. FIELD OF THE INVENTION

The present invention relates to the lighting industry and is directed more particularly to a connector mechanism adapted to link elongate fluorescent fixtures in end to end abutting relation.

2. PRIOR ART

In certain lighting installations and particularly in commercial lighting installations, it is conventional to provide an elongate lighting assembly comprised of a multiplicity of fluorescent fixtures or luminares mounted in end to end abutting relation so as to illuminate an elongated area. The individual fixtures which are to be interconnected may be of a length of up to ten feet each. In accordance with current practice, the fixtures are suspended from depending rods or tubes, the upper ends of which are mounted to structural supports within the ceiling installation. One or more of the supporting tubes or rods may include the electrical mains for energizing the fixtures.

Heretofore, the end to end coupling of the individual fixtures has been a time consuming and labor intensive operation requiring a preliminary partial disassembly of the fixtures, alignment of the disassembled fixtures in end to end abutting relation, and bolting or otherwise fastening the abutting end portions of the fixtures by conventional connector means extending through from an end portion of one fixture to an end portion of another fixture. After the bolts have been applied, the fixtures which have been partially disassembled to provide access to the interior must be reassembled. Since the fixtures are normally positioned substantial distances from the floor, it would be readily recognized that in such installations workmen must perform numerous operations while standing on ladders or like platforms. Since as noted, the individual fixtures may be up to ten feet in length, manoeuvering the fixtures into appropriate position for interengagement involves a sequence of cumbersome manipulative steps as does the reassembly of the fixture housings after fixture interconnection has been completed.

SUMMARY OF THE INVENTION

The present invention is directed to a connector mechanism for linking successive fluorescent fixtures in end to end abutting relation in a manner which does not require disassembly or subsequent reassembly of the fixtures. The invention is further directed to a mechanism of the type described wherein loose connectors such as bolts, screws, etc. are not employed, all elements for the interfastening of the fixtures forming a permanent part of the connecting mechanism. The invention is further directed to a connecting mechanism of the type described wherein the end components of adjacent fixtures may be rigidly interconnected by the operation of a single threaded device accessible from the exterior of the fixtures whereby disassembly of the fixtures is obviated.

In accordance with the invention there is provided a fixture interconnecting mechanism comprised of a pair of end plates forming permanent portions of the respective fixtures, one of the end plates forming an element of the connector mechanism including a vertically shiftable slide having outwardly directed hooks, the hooks including cam faces inclined toward the end plate. The other of the end plates incorporates a locking slide provided with slots terminating in locking shoulders. The locking slide may be vertically shifted by a threaded mechanism interposed between the locking slide and the end plate carrying the slide, whereby interconnection of the end plates may be effected by passing the hooks through the slots of the locking slide in such manner that the locking shoulders bear against the cam surfaces of the hooks. By thereafter actuating the thread mechanism, the locking slide is shifted vertically causing the locking shoulders to engage against the cam surfaces thereby drawing the end plates into tight interengagement. Preferably, the end plates include complimental stud and socket components engageable by relative horizontal movement of the end plates whereby the end plates are locked into position both by the engagement of the studs and sockets and by the horizontal components of force exerted between the plates as a result of tightening the threaded mechanism.

It is accordingly an object of the invention to provide a novel connector mechanism adapted to link in end abutting relation two or more elongate fluorescent lighting fixtures or luminares. A further object of the invention is the provision of a mechanism of the type described wherein the interlocking action may be effected by rotation of a single threaded member for actuating the locking slide. Still a further object of the invention is the provision of a connector mechanism of the type described which may be engaged by a relative horizontal movement of the adjacent luminares without the necessity of tilting or canting one luminare relative to the other.

BRIEF DESCRIPTION OF THE DRAWINGS

In order to attain these objects or such other and further objects as may appear herein or be hereinafter pointed out reference is made to the accompanying drawing in which:

FIG. 2 is an end elevational view of the elements of the connecting mechanism in their coupled condition taken in the direction of the arrows 2—2 of FIG. 3.

FIG. 4 is a horizontal section taken on the line 4—4 of FIG. 2.

DETAILED DESCRIPTION OF THE DRAWINGS

Figure 1:
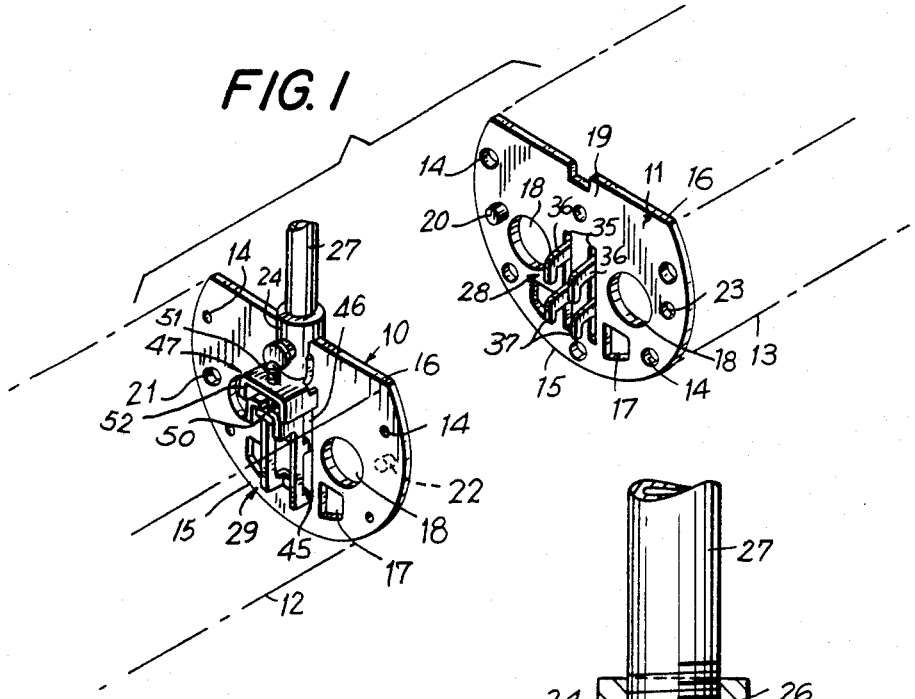
FIG. 1 is a perspective view of the elements of the connector mechanism in their preassembled condition, the outlines of the luminare housing being shown in phantom.

In FIG. 1 there is disclosed a connector mechanism in accordance with the invention, the mechanism comprising first and second end plates 10 and 11, which are adapted to be secured to and define the ends of the housings of adjacent fluorescent fixtures 12 and 13 respectively. Since the fluorescent fixtures are in all respects conventional with the exception of the connector mechanism, details thereof need not be hereinafter described. Plates 10, 11 may be secured to the housings 12, 13 as by conventional threaded fastening means passed through securement apertures 14 formed in the plates.

The end plates 10, 11 are depicted as partially circular including an arcuate lower portion 15 and a flat upper portion 16. As will be understood by those skilled in the art, the plates are susceptible of being inverted such that the flat side is down and the arcuate side is up dependent upon whether it is desired that the light of the fluorescent fixture is to be cast downwardly or upwardly.

As is conventional, the end plates may include throughgoing apertures such as apertures 17 and 18 to permit passage of conduits and to provide clearance for portions of the fluorescent tube receiver sockets.

The outermost face 19 of plate 11 includes an outwardly projecting stud 20 positioned to align with a throughgoing aperture 21 in plate 10. In similar fashion an outwardly projecting stud 22 is formed on plate 10, the stud 22 being positioned to align with receiver socket 23 in plate 11. It will be appreciated that when the plates 10, 11 are locked in end abutting relation as shown for instance in FIG. 3, the studs and sockets 20, 21 and 22, 23 respectively will key the plates together against relative rotational or other movements.

Plate 10 may be provided with a hanger bracket 24 secured thereto as by bolt 25, the upper end of the bracket including a threaded receiver socket 26 adapted to be connected to hanger rod or pipe 27 depending from the ceiling structure.

Next will be described the connector mechanism which functions to hold the end plates tightly together and maintain the studs and sockets previously described in their engaged position. The locking components of the connector mechanism comprise a vertically shiftable slide assembly 28 mounted on plate 11 and a complimental locking slide assembly 29 mounted on plate 10. The slide assembly 28 is generally u-shaped in horizontal section including a back plate or web member 30 having a vertically directed slot 31 spanning vertically directed rib 32 secured to the plate 11. The thickness of the rib 32 is greater than the thickness of the web 30 whereby a pair of mounting bolts 33 and washers 34 secure slide 28 to the inner face of plate 11 while permitting vertical sliding movement.

Figure 3:
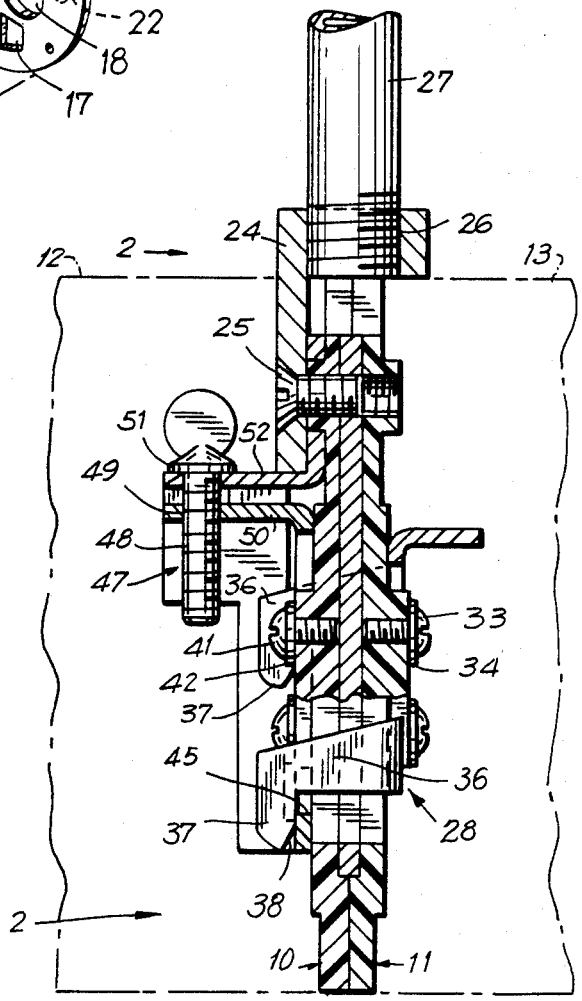
FIG. 3 is a vertical section taken on the section lines 3—3 of FIG. 2.

The end plate 11 includes a pair of parallel vertically directed slots 35 through which project hook members 36 integral with the slide 28. As best seen in FIG. 3, the hook members include depending tangs 37, the tangs having on their inner face, i.e. the face directed toward the outer surface of plate 11, a cam component 38 which is inclined in the direction of the outerface of the plate 11.

While the illustrated embodiment of the invention discloses a structure incorporating four hook like members 36, it will be readily recognized that one, two, or more such hooks will provide a functional arrangement, the use of four such hooks being recommended for additional stability.

The locking slide 29 is likewise u-shaped in horizontal section including a central slot 39 which extends vertically and is guided on rib or projection 40 formed on the inner face of end plate 10. The slide 29 is supported for vertical movement by bolts 41 and washers 42 which bear against the outer surface of the rib 40 while providing sufficient clearance with a central plate 43 of slide 29 to permit vertical movements of the slide 29.

The central plate 43 is provided with four vertically directed slots 44 spaced to correspond with the spacing of the hook members 36. The terminal ends of the slots 44 define locking shoulders 45 which, as will be hereinafter described, coact with cam surfaces 38 of the hooks 36 to draw the end plates 10 and 11 into tight interengagement. The plate 10 is provided with a spaced pair of vertical slots 46 which register with the slots 44 formed in the plate 29.

A threaded locking assembly is coupled with slide 29 for shifting the same in a vertical direction. The locking assembly includes a vertically extending threaded member 47 having a shank portion 48 mounted in complimentally threaded aperture 49 formed in a branch 50 of the slide 29. The threaded member 47 includes a stop shoulder 51 which bears against apertured bracket arm 52 secured to the inner face of the plate 10. As will be appreciated from an inspection particularly of FIG. 3, by appropriate rotation of the threaded member 47 (which is illustrated in the instant embodiment as comprising a thumb screw but which equally may be driven by an allen wrench or the like) the vertical positioning of the slide 29 may be determined.

Figure 5:
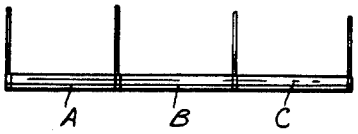
FIG. 5 is a side elevation view on a smaller scale of a series of fluorescent fixtures linked by a mechanism of the invention.

The operation of the connector mechanism will be readily understood from the preceeding description. In FIG. 5, there is disclosed in schematic nature a series of three fluorescent fixtures A, B, C coupled by connector mechanisms of the type described. In order to connect fixture B to previously mounted fixture A, the hook components 36 projecting from end plate 11 of fixture B are passed through the vertical slots 46 in the end plate 10 of fixture A and through the slots 44 in the slide 29 of fixture A. During the mounting procedure and to facilitate interengagement of the hooks 36 and slide 29, the threaded member 47 is released from the tightened or downward position shown in FIG. 3 to an upward or releasing position (see dot and dash lines FIG. 2) whereby the plate 29 is permitted a significant degree of vertical free movement. Since at this stage of the installation both the hooks 36 and end plate 29 are free to shift vertically, manipulation of fixture B to dispose the hooks in their desired relation within slide 29 is facilitated. The horizontal expanse or projection of the hooks 36 is sufficiently great to permit relative vertical movements between plates 10 and 11 while the hooks extend through the slots 44 in plate 29. It will thus be appreciated that the length of the hooks must be sufficiently great to enable the studs 20 and 22 to be shifted vertically relative to the opposing plates without jamming between the studs and the outer surface of the opposing plates.

After engagement of the hooks 36 within slots 44 of slide 29, threaded member 47 is tightened to the position shown in FIG. 3 and solid line in FIG. 2 with a concommitant drawing upwardly of the slide 29. In the course of such upward movement, the locking shoulders 45 of the slide will bear against cam surfaces 38 of the hook members 36, resulting in a horizontal shifting movement of plates 10 and 11 toward each other until further rotation of the locking member is no longer possible. In the course of the tightening movement of the member 47,the studs 20 and 22 will enter the receiver apertures 21 and 23 respectively keying the end plates 10 and 11 in a precisely aligned condition. The threaded member is rotated until the components jam into locked position.

From the foregoing description, it will be recognized that there is provided a connector mechanism for linking the end components of fluorescent fixtures wherein the connection is effected by rotation of a single threaded member permanently affixed to an end plate of one of the fixtures. In view of the proximity of the threaded adjusting or locking member to an end plate, it is possible to provide a small access aperture in reflector or other component of the fluorescent housing so that the threaded member may be actuated by reaching into the housing or by passing a wrench, screw driver, or the like into the interior of the housing.

As will be evident to a worker in the art familiarized with the instant disclosure, numerous variations in details of construction may be effected without departing from the spirit of the invention. For instance, as noted, multiple hook and slot arrangements are not required, the device being operable with a single hook and slot. Also, the relative orientation in a strictly vertical direction of the respective slides is not manditory. Similarly, it is contemplated to connect two fixtures at right angles by securing an end plate parallel to rather than at right angles to the longitudinal axis of the fixture. Accordingly, the invention is to be broadly construed within the scope of the appended claims.

What is claimed as new and sought to be protected by letters patents is:

1. A connector mechanism for linking successive fluorescent fixtures in end to end abutting relation comprising first and second planar end plates adapted to be secured to the ends of abutting said fixtures, said first end plate including an outwardly extending hook member having a vertically directed tang, said tang having a cam face inclined toward said first end plate, said second end plate including a vertically extending opening, a slide member vertically moveably mounted on an inner face of said second end plate, a vertically directed slot formed on said slide member in alignment with said opening, said slot being sized to receive said tang therethrough, a locking shoulder formed at an end portion of said slot, threaded means interposed between said second end plate and said slide member for shifting said slide member vertically in accordance with the adjusted position of said threaded means, said cam face, in the inserted position of said tang in said slot, being positioned in the path of said locking shoulder whereby vertical movements of said slide member urge said shoulder against said cam face and concommitantly urge said plates against each other in a horizontal direction.

2. A connector mechanism in accordance with claim 1 wherein one said end plate includes a horizontally directed stud member and the other said end plate includes a stud receiver socket, said stud member and socket being positioned to be engaged by horizontal relative movement of said end plates, said stud member cooperating with said socket in the inserted position thereof to lock said end plates against relative vertical movement.

3. A connector mechanism in accordance with claim 2 wherein said hook member is mounted for vertical sliding movement relative to said first end plate.

4. A connector mechanism for linking a first elongate fluorescent fixture to a second said fixture comprising first and second end plates secured to the respective adjacent ends of said fixtures, a hook member on said first end plate projecting horizontally outwardly beyond said end plate, said hook member including a cam surface inclined toward an outer surface of said first end plate, said second end plate including an opening through which said hook member extends, a slide movably mounted on an inner surface of said second end plate, said slide being shiftable relative to said second end plate in a direction aligned with said cam surface, a slot formed in said slide, said slot being elongated in the direction of movement of said slide, a locking shoulder formed at a terminal end of said slot, said hook member extending through said slot with said locking shoulder juxtaposed to said cam surface, and threaded means interposed between said second end plate and said slide for shifting said locking shoulder along said cam surface to thereby urge said plates against each other.

5. A connector mechanism in accordance with claim 4 wherein one said end plate includes a horizontally directed stud member and the other end plate includes a stud receiver socket, said stud member and socket being engaged in the connected condition of said end plates to thereby lock said plates against relative movement.

6. A connector mechanism in accordance with claim 5 wherein said hook member is mounted to said first end plate for sliding movement in a direction parallel to the direction of movement of said slide.

* * * * *